United States Patent [19]

Guillaume

[11] Patent Number: 4,746,289

[45] Date of Patent: May 24, 1988

[54] HEAT TREATING PROCESS, HOOD FOR CARRYING OUT THIS PROCESS, AND ITS USE IN HEAT TREATING FURNACES

[75] Inventor: Vincent Guillaume, La Rochette, France

[73] Assignee: L'Air Liquide, Paris, France

[21] Appl. No.: 868,944

[22] Filed: May 30, 1986

[30] Foreign Application Priority Data

Jun. 5, 1985 [FR] France ..... 85 08470

[51] Int. Cl.[4] ..... F27B 9/28; F26B 19/00

[52] U.S. Cl. ..... 432/8; 432/59; 432/64

[58] Field of Search ..... 432/8, 59, 64, 67, 72

[56] References Cited

U.S. PATENT DOCUMENTS

| | | | |
|---|---|---|---|
| 2,668,701 | 2/1954 | Dietrich | 432/8 |
| 3,223,396 | 12/1965 | Thompson | 432/72 |
| 3,467,366 | 9/1969 | Western | 432/64 |
| 3,744,963 | 7/1973 | Flynn | 432/59 |
| 3,984,197 | 10/1976 | Birke et al. | 432/59 |
| 4,217,090 | 8/1980 | White et al. | 432/59 |
| 4,231,167 | 11/1980 | Duris | 432/59 |
| 4,501,553 | 2/1985 | Imose et al. | 432/8 |
| 4,551,091 | 11/1985 | Paterson | 432/64 |

FOREIGN PATENT DOCUMENTS

| | | |
|---|---|---|
| 45438 | 3/1983 | European Pat. Off. . |
| 2068909 | 9/1971 | France . |

*Primary Examiner*—Henry C. Yuen

*Attorney, Agent, or Firm*—Lee C. Robinson, Jr.

[57] ABSTRACT

The process comprises creating a screen of non-reactive or inert gas at least at one of the two ends of the heat treating zone or cooling zone of a furnace, the screen being substantially homogeneous and laminar throughout its height. The use of this process permits, on the one hand, a reduction in the flows of gas necessary for the heat treating and, on the other hand, the division of the heat treating furnace into precise zones. The invention is particularly applicable to heat treating furnaces.

6 Claims, 6 Drawing Sheets

HEAT TREATING PROCESS, HOOD FOR CARRYING OUT THIS PROCESS, AND ITS USE IN HEAT TREATING FURNACES

The present invention relates to a process for heat treating parts in a continuous furnace comprising at least one heat treating zone, in which process there is created a non-reactive gas atmosphere under the treating conditions at at least one of the ends of said treating zone.

In heat treating processes such as case hardening, nitriding, sintering, annealing, etc., it is usually desirable to maintain a reducing or non-oxidizing atmosphere in the treating furnace. For large series of parts, the furnaces are usually continuous and open at both ends. They comprise an inlet zone for the parts to be heat treated, a heat treating zone and usually a cooling zone and an outlet zone for the parts. The furnace includes a system for feeding the parts to the heat treating zone, the temperature of the parts progressively rising as they travel into the furnace. When the heat treatment has finished, the part usually passes through a cooling zone in which it is cooled to such temperature that no oxidation of the part will occur in the ambient air.

The required heat treating atmosphere, which is usually reducing or neutral, is supplied to the furnace by endothermic or exothermic generators or by the direct injection of suitable liquid-gas mixtures. The injection of this atmosphere is usually effected in the heat treating zone or in the vicinity of the latter. It is necessary to achieve a overpressure of the atmosphere-generating gas at its point of injection in an effort to avoid the rising in the furnace of the oxidizing species contained in the air.

A first solution to this problem of the rising in the furnace of the oxidizing species has been disclosed in U.S. Pat. No. 3,467,366. There is provided at the inlet and outlet of the furnace a confined zone formed by a plurality of screens defining a plurality of chambers. An inert gas atmosphere is injected into the central chamber by means of a perforated tube placed at the base of this chamber so as to create a plug preventing the ambient air from rising in the atmosphere of the furnace and oxidizing the parts in the course of treatment. In the chamber adjacent to the furnace and to the central chamber there are provided suction means which cooperate with those disposed in the central chamber so as to draw off the atmosphere of this chamber which may be polluted by the oxidizing species coming from the central chamber. The air drawn off is expelled to the exterior atmosphere.

The system disclosed in U.S. Pat. No. 3,467,366 also ensures that the gaseous atmosphere of the furnace is not ejected from the furnace and mixed with the ambient air, which will reduce the quantity of gas injected into the treating furnace during a given period of time.

Such a system has many drawbacks. Firstly, the injection of inert gas through a perforated tube creates a swirling current in the chamber: in respect of perforations located on the same circumference of the tube, the geometry tends to create a first swirling zone around the tube. Further, as the inert gas is supplied at one of the ends of the perforated tube whose other end is closed, the gas will have a tendency, for a given perforation diameter, to escape through the end located in the vicinity of the closed part and create a suction through the perforations located in the vicinity of the arrival of the inert gas and thus produce a second swirling zone in the chamber.

This explains the necessity to provide a suction system located downstream of the chamber bearing in mind the fact that the swirling produced in this chamber creates a suction of air in the furnace. The suction system discharges the air-inert gas mixture before the latter can enter the heat treating zone of the furnace.

The system disclosed in U.S. Pat. No. 3,467,366 therefore requires the use of both a confining chamber provided with screens and filled with an inert atmosphere and a suction system combined with this chamber.

More recently, there has been proposed in European patent application EP No. 75,438 a heat treating process adapted to avoid the penetration of oxidizing species in the furnace.

The inlet and outlet zones of the furnace comprise a plurality of screens disposed parallel to each other and defining a plurality of chambers into which an inert gas such as nitrogen is injected. This injection is effected through a perforated wall located above and/or below said chambers. The injection of nitrogen through these perforated walls is achieved by means of a conduit in front of which there is placed a deflector, the gas passing around the latter before entering said chambers through the perforations.

This produces an overpressure in said chambers with respect to the pressure of the atmosphere of the cooling zone of the furnace the cooling zone pressure is higher than the pressure of the heat treating zone of the furnace, the latter being higher than atmospheric pressure.

Such a device has a number of drawbacks. Firstly, the overpressure imposed inside the chambers relative to all of the various parts of the furnace requires the use of a large volume of nitrogen. Moreover, it is also found that swirling currents exist between the various chambers. Indeed, the current of nitrogen which passes around the deflector reaches the outer part of the perforated zone with a higher velocity than in the central zone. The pressure drop created in the gas when passing through the openings is therefore lower in this central zone than in the outer parts of the perforated plate. Under these conditions, the nitrogen has a tendency to enter the central chambers and create suction through said openings in the region of the outer parts of the perforated plate and thus produce a swirling of the nitrogen inside said system. This is particularly disadvantageous in the first chamber which is in direct contact with the exterior air. The air is thus drawn into the system and then redistributed with the nitrogen in the various chambers. This current of nitrogen and air is then drawn toward the interior of the furnace in the heat treating zone. Consequently, the treating atmosphere includes an appreciable proportion of oxidizing species coming from the air drawn in from the exterior of the furnace. Therefore it is necessary to associate with this system a distribution of the pressures of the gases which decreases from the outlet of the furnace to the central part of the latter.

In the two systems analyzed hereinbefore, the same drawbacks are therefore found, namely essentially the drawing in of air to the heat treating zone of the furnace.

Although these systems constitute improvements over the prior system in which the ends of the furnace were open, it is found that the problem of the entry of air into the furnace is not completely solved thereby.

This in particular means that the solutions disclosed in the two aforementioned patents cannot be applied to certain heat treatments, such as the annealing of stainless steel, since it is necessary for this type of application to have an extremely small quantity of oxygen in the furnace and at the beginning of the cooling zone in view of the avidity of chromium for oxygen.

The process according to the invention avoids this drawback. It is characterized in that said atmosphere of non-reactive gas is created by a substantially homogeneous screen of gas injected in a plane through which the direction of feed of the parts to be treated passes, the injection of non-reactive gas occurring under such conditions that a substantially laminar flow is maintained throughout the height of the screen of non-reactive gas.

The use of a screen of gas which is homogeneous and laminar throughout its height avoids the air suction phenomena. Thus, process according to the invention notably simplifies the devices carrying out this process, since it is then neither necessary to add to the unit a suction system nor necessary to provide a plurality of screens of inert gas.

Preferably, the screen of substantially homogeneous gas is produced at each of the ends of the furnace, the pressure drops resulting therefrom being different from each other so as to modify the relative value of the gas flows at the inlet and outlet of the furnace.

The use of the process according to the invention in particular enables heat treating furnaces to be divided into zones. In the case where the furnace has a plurality of points of injection of different atmospheres, the presence of the homogeneous inert gas screen at one end or the other of the furnace permits, depending on the modulation of the flows of neutral gas injected into each screen, a distinct modification of the conditions of the exit of the gases at each end of the furnace compared with the pressure drops imposed on the gas in motion inside the furnace. This results in a modification of the gas flows on each side of the gas injection points and in particular creates between two injection points a zone where the mean velocity of circulation of the gases is zero, resulting from a pressure which is substantially identical at these two points. The atmospheres injected at these two points diverge with respect to each other.

When there is a point of injection of gas at a pressure higher than that of the gases injected at the other points, this point of injection will permit an orientation of the gas flows in the furnace. If it is located close to the inlet of the furnace, the gas flow will be the same as the direction of feed of the parts. Conversely, if it is located in the vicinity of the outlet of the furnace, the gas flow will be in the opposite direction to the feed of the parts in the furnace.

It is in particular found that it is possible to better locate the maximum pressure zone of the furnace in the required region, in the case of a plurality of injections at different points, without this increasing the flows of the active gases.

The expression "non-reactive gas" used in the present description means of course a gas which is inert or non-reactive with respect to the other constituents of the atmosphere of the furnace and to the parts which must be treated in the latter. Usually, nitrogen will be used as the non-reactive gas, although in some cases it is preferable to use argon or possibly helium.

The expression "active gas" designates the gas or gases of the heat treating atmosphere.

The expression "heat treating" encompasses all heat treatments carried out on metals, ceramics, etc., but particularly concerns the annealing of metal parts such as stainless steel.

The expression "heat treating zone" means one or more parts of the furnace in which heating means are possibly disposed and in which identical or different atmospheres are created, each atmosphere being preferably homogeneous. It also encompasses the case where the heat present in this zone comes from the part itself which enters the heat treating zone for the purpose of undergoing a transformation such as hot rolling, etc.

It will be understood that the process according to the invention is of utility in all continuous furnaces of the horizontal or vertical type. However, in the case of vertical furnaces, the conditions of homogeneity imposed on the inert gas screens are such that the inlet and/or outlet zones provided with homogeneous gas screens according to the invention will have to be located in non-vertical parts of the furnace.

Usually, the non-reactive gases and the reactive gases for the heat treating of the parts are directly injected into the heat treating zone of the furnace, or in the vicinity thereof. However, it is possible to introduce these gases into a part of the cooling zone or in the vicinity of the inlet zone of the furnace. The use of the process according to the invention will enable the flow of these gases to be directed toward the interior of the furnace and will enable the latter to be divided into zones.

According to another aspect, a feature of the process according to the invention is that said atmosphere of inert or non-reactive gas is created by a current of inert gas injected vertically at the inlet of the almost homogeneous furnace and having a laminar flow with a rate of flow equal to the rate of flow of air entering the furnace in the absence of injection of inert gases.

The injection of a homogeneous and laminar flow of inert gas throughout the width of the furnace and in particular in the zone located in the vicinity of the conveyor belt feeding the parts into the furnace, requires specially adapted apparatus, such as the hood which will be described hereinafter.

In the absence of special measures according to the process of the invention, the air enters the furnace as a result of natural convection phenomena through the lower part of the inlet zone, since this air is much cooler than the atmosphere issuing from the furnace. Under these conditions, it has been found that, when the screen of inert or non-reactive gas is injected downwardly, the presence of screens, preferably refractory screens, on each side of the gas screen is necessary, these screens extending almost to the belt conveying the parts through the furnace.

Conversely, when the gas is injected upwardly, it has been found that the presence of said refractory screens is unnecessary, except of course in cases in which it is desired to create zones in the furnace, i.e. successive zones of given atmospheres. These refractory screens indeed produce a sufficient pressure drop at the inlet and/or outlet of the furnace to control the currents of the gases of the atmosphere from their points of injection to the inlet or the outlet of the furnace.

The use of the process according to the invention is found to be particularly effective when the continuous furnaces have a short inlet zone and/or a large difference in temperature between the gases issuing from the furnace and the ambient temperature (for example a temperature difference exceeding 300° C.).

According to a preferred embodiment, the homogeneous inert gas screen is created by means of a hood which permits the maintenance of the flow of non-reactive gas in a laminar and substantially homogeneous manner at every point of the gas screen.

To achieve this result, the hood according to the invention comprises:

means for injecting inert gas into an inlet chamber whose bottom is perforated;

means permeable to the inert gas disposed on the perforated bottom of the inlet chamber and enabling a very low velocity to be imparted to the flow of inert gas at the outlet of the perforated plate without producing a substantial pressure drop in the region of the gas flow;

at least one screen on each side of the gas flow which is movable around an axis located in the plane of the screen and disposed in the passage of the parts to be treated.

Preferably, the inlet chamber will have a substantially rectangular perforated bottom whose length is equal to the width of the furnace on which the hood is adapted to be mounted, the velocity of the non-reactive gas being necessarily identical at every point of passage through the perforated plate and less than:

$$1000 \times n \times (a+b)/(p \times a \times b),$$

wherein n = viscocity of the non-reactive gas used in the hood, at the ambient temperature, p = voluminal mass of said non-reactive gas under normal conditions, a = width of the furnace and length of the rectangular perforated plate, b = depth of the rectangular perforated plate (distance between the two screens).

The screens employed in this hood will preferably take the form of those described in the aforementioned U.S. patent screens of this form are constituted by a plurality of elements of different lengths and are better adapted in particular to furnaces in which parts of different shapes are treated.

The material of said screens should not adversely affect the non-reactive gas flow of the hood and should be able to withstand the temperatures to which the screens are subjected.

Sintered materials, such as materials of the rock wool, quartz wool, or glass wool type having a thickness of at least two centimeters, are particularly suitable for use as the gas permeable means in this application.

The inlet chamber for the inert or non-reactive gas has generally a parallel-sided shape whose base is formed by the perforated plate. It has been found that the best results of continuity and homogeneity of the gas screen are achieved when the height of this inlet chamber is equal to at least twice the thickness of the material permeable to the neutral gas. In this way, the pressure gradients, and therefore the swirling inside this inlet chamber, are substantially reduced.

The means for injecting the inert gas into the inlet chamber will be generally in communication with the latter through a plate on the side of the chamber opposed to its perforated side. It has been found that it is preferable to dispose the neutral gas inlet substantially in the centre of this plate to provide symmetry of the injection of said neutral gas.

However, it is not always possible, bearing in mind the geometry of the heat treating furnace, to inject the gas in the upper part of the inlet chamber. In this case, this injection must be effected on one of the lateral sides of the inlet chamber. It is then preferable to arrange that the inert gas inlet passage be connected to the inlet chamber through a pre-inlet chamber which is substantially symmetrical about the inlet axis of the inert gas. Preferably, the connection zone between this pre-inlet chamber and the inlet chamber is formed by a gas permeable structure similar to those described hereinbefore. This permits in particular the arrival of gas which, even though not symmetrical, has particularly low velocities without swirling, and a homogeneity of pressure and velocity in the inlet chamber, which results, owing to the symmetry of the unit, in a homogeneity of the inert gas screen injected at the inlet and/or outlet of the heat treating furnace.

The invention also relates to the use of the process in a heat treating furnace comprising a hood such as defined hereinbefore, at least at the inlet and/or outlet of the furnace. This hood is preferably disposed with its inlet chamber placed above the parts to be treated. It is also possible to place this hood in the lower part of the furnace. Of course, in this case, the perforated plate of the inlet chamber faces the parts to be treated, while the screens permitting the confinement of the laminar homogeneous gas flow are suspended from the upper part of the furnace. In other cases, it is desirable to use a hood placed in the upper part of the furnace and provided with its screens, while a second inlet chamber is placed in the lower part of the furnace so that the inert gas flow which issues from the perforated plate of this second chamber will be located between the screens of the upper hood.

According to a preferred embodiment, a hood is disposed at each end of the furnace, the pressure of the inert gas injected into each of the hoods being different and the pressure drops produced by each gas screen being different from each other, so as to modify the relative value of the gas flows at the inlet and outlet of the furnace. The flow of said heat treating gases can thus be oriented in the desired direction with respect to the direction of feed of the parts to be treated. In particular, the flow of the gases may be oriented in a countercurrent manner to the direction of feed of the parts, according to the type of heat treating to which said parts are subjected. In some cases, this pressure difference may result in the absence of injection of inert gas into one of the hoods.

A better understanding of the invention will be had from the following description of embodiments which are given merely by way of non-limiting examples with reference to the accompanying drawings in which.

Figure 1:
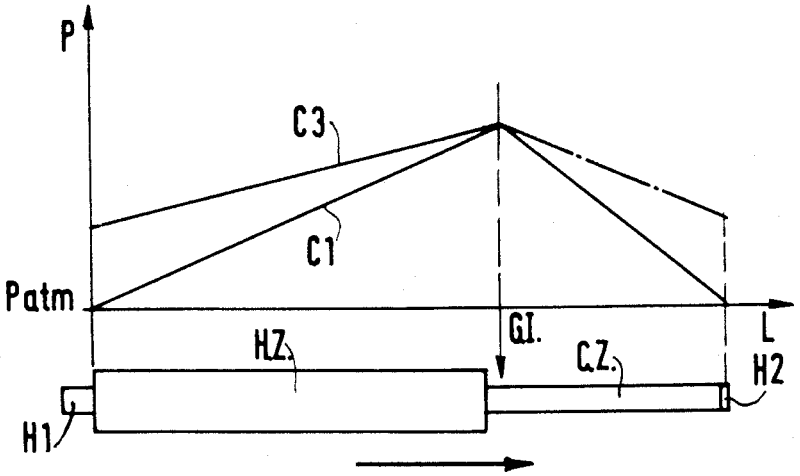
FIG. 1 shows the pressure variations in a heat treating furnace with and without a hood.

Diagrammatically shown in FIG. 1 is a heat treating furnace comprising in succession an inlet zone $H_1$ followed by a hot heat treating zone HZ, which is followed by a cooling zone CZ at the end of which is provided the outlet zone $H_2$. In the presently-described embodiment, the injection of heat treating gas is effected at point GI substantially in the zone of separation of the hot zone HZ from the cooling zone CZ. The curves shown above the diagrammatic view of this furnace give, as ordinates, the pressure and, as abscissae, the distance of the considered point from the inlet zone of the furnace. The curve $C_1$ represents the variations in the pressure of the heat treating gas injected at point GI for a conventional open furnace of the prior art. In this case, the maximum pressure of the heat treating gas is located at GI which is the point of injection of this gas, the pressure of the gas which travels, on one hand, in the direction of the hot zone and, on the other hand, in the direction of the cooling zone, being equal in the zones $H_1$ and $H_2$ to atmospheric pressure. The curve $C_3$ shows the contour of the pressures in the furnace after having placed a screen of homogeneous inert gas at the ends of the furnace in accordance with the invention. The pressure is then maintained maximum at the points of injection of the gas and decreases to a value which remains higher than atmospheric pressure in the vicinity of the inlet and outlet zones of the furnace. If Pa designates atmospheric pressure, $Ph_{max}$ the maximum pressure in the hood, $Pt_{max}$ the maximum pressure in the heat treating zone and $Pf_{max}$ the maximum pressure in the cooling zone of the furnace, the process according to the invention in a preferred mode is characterized by one of the following relations:

$$Pa < Ph_{max} < Pt_{max} \geqq Pf_{max} > Pa$$

or $$Pa < Ph_{max} < Pf_{max} \geqq Pt_{max} > Pa$$

In practice, Pt max or Pf max is on the order of $10^{-1}$ to $10^{-2}$ 10 Pascal above atmospheric pressure.

Figure 2:
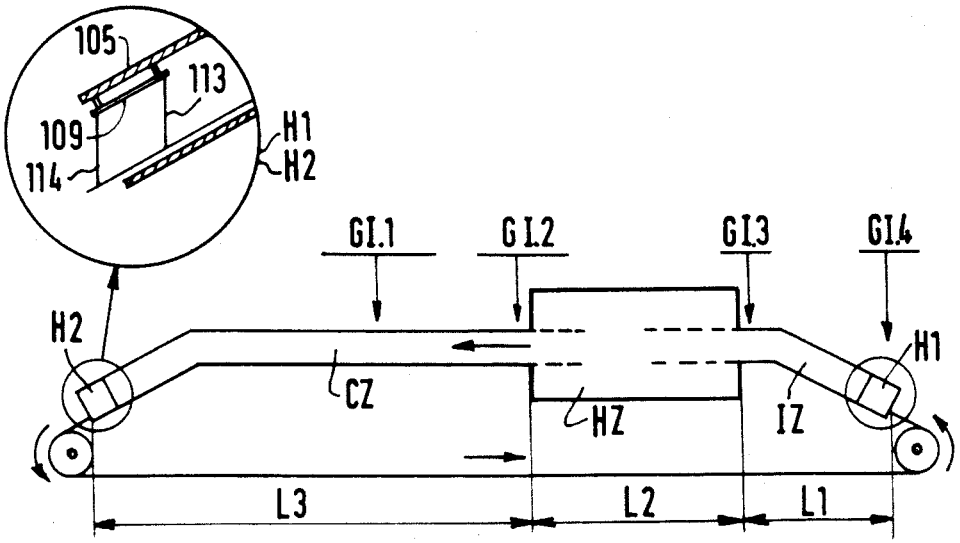
FIG. 2 shows a diagrammatic arrangement of an open furnace.

FIG. 2 is a diagrammatic view of an open furnace having a conveyor belt for annealing stainless steel, according to the invention. This furnace comprises in succession an inlet hood $H_1$ described in more detail hereinafter, a zone IZ for introducing the parts to be treated, of length $L_1$, a heat treating zone HZ, of length $L_2$, then a cooling zone CZ, of length $L_3$, and a hood $H_2$ identical to the hood $H_1$. Different points of injection of the gases are provided including the injection point GI.1 substantially in the middle of the cooling zone CZ, the injection point GI.1 between the cooling zone CZ and the injection heat treating zone HZ, the point GI.3 at the entrance of the heat treating zone HZ, and the injection point GI.4 at the entrance of the zone IZ.

Figure 3A:
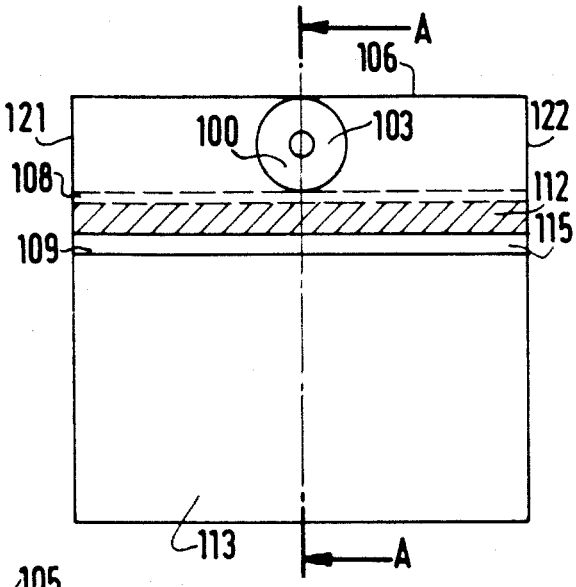
FIG. 3A is a front elevational view and FIG. 3B is a sectional view of a hood employed in the process according to the invention.
Figure 3B:
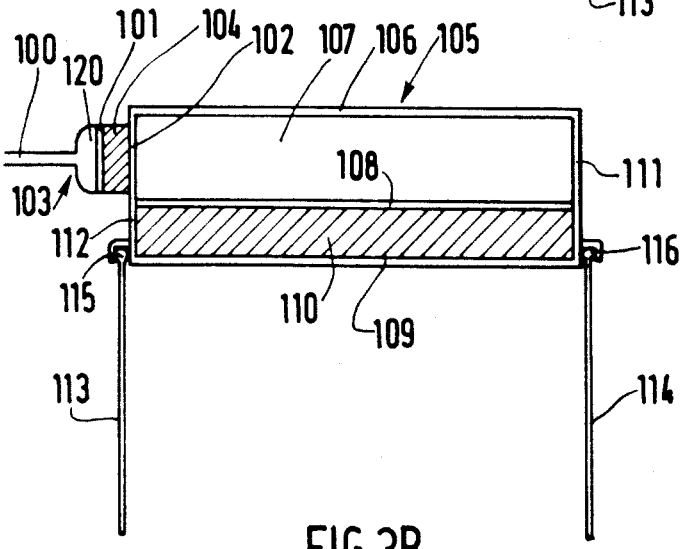

FIG. 3A is a front elevational view and FIG. 3B a sectional view of a hood according to the invention. It is formed by a duct 100 supplying inert gas to the inlet of the pre-inlet chamber 103. The latter is of substantially cylindrical shape and has a diameter substantially equal to the height of the zone 107 of the inlet chamber (see hereinafter). The pre-inlet chamber 103 comprises two zones having substantially the same volume, namely a first zone 120, followed by a second zone defined by two perforated plates 101, 102 between which a blanket of rock wool 104 is disposed. The perforated plate 102 opens into the inlet chamber 105 of substantially parallel-sided shape. The inlet chamber 105 includes a perforated upper wall 106 and a perforated lower wall 109, the latter wall being covered with a blanket of rock wool 110 itself covered with an intermediate perforated wall 108. A gas expansion chamber 107 is located between the wall 108 and the upper wall 106 of this inlet chamber. The height of this expansion chamber is at least equal to the height of the blanket of rock wool 110. The inlet chamber 105 is laterally defined by walls 111 and 112 and 121 and 122. Located adjacent to the lower part of said walls 111 and 112 are two fixing strips 115, 116 parallel to said walls on which two refractory screens 113, 114 are hooked. The height of these screens is such that they come into contact with the conveyor belt feeding the objects in the furnace.

Figure 4A:
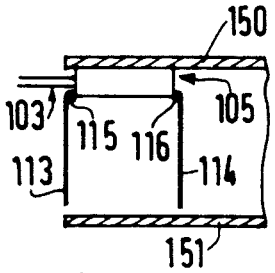
FIGS. 4A, 4B and 4C are different arrangements of hoods in a furnace according to the invention.
Figure 4B:
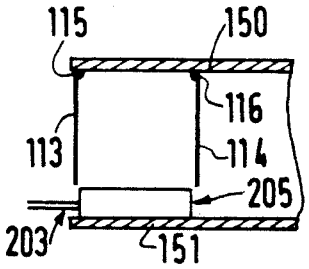
Figure 4C:
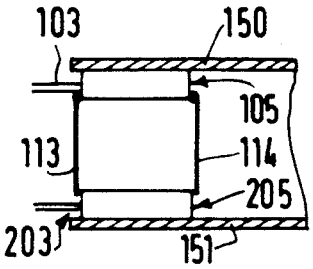

FIGS. 4A, 4B and 4C show various ways of securing hoods in a furnace, the same elements as those of the preceding Figures carrying the same reference characters.

FIG. 4A shows diagrammatically a hood secured in the upper part of the furnace, FIG. 4B shows a hood secured in the lower part of the furnace, and FIG. 4C shows a variant with two diffusion chambers and a single pair of screens.

In FIG. 4A, 150 and 151 respectively represent the upper and lower walls of the furnace. The refractory screens 113 and 114 extend substantially to the lower wall 151 of the furnace.

In FIG. 4B, the refractory screens 113, 114 are fixed by their fixing strips 115, 116 to the upper wall 150 of the furnace, and the expansion chamber 205 (identical to the previously-described chamber 105) is fixed to the lower wall 151 of the furnace, the perforated plate of said chamber 205 of course facing toward the upper wall 150 of the furnace. The injection of the gas into the chamber 205 occurs through the pipe 203, the ends of the screens 113 and 114 extending down to substantially the level of the perforated wall of the chamber 205.

FIG. 4C shows a variant with a single pair of screens and two inlet chambers 105 and 205 respectively. The relative dispositions of the two chambers 105 and 205, which are substantially identical to each other, are such that the refractory screens 113 and 114 in a vertical position surround the inlet chamber 205 so as to maintain the gas injected through the pipes 103 and 203 between said screens 113 and 114.

EXAMPLE 1

The following embodiment concerns a continuous open furnace for annealing a steel tube. The atmosphere used in this annealing furnace has substantially the following composition: 10% of $H_2$, 8% of CO, 4% of $CO_2$, 78% of $N_2$ (by volume), dew point: about 0° C.

This furnace comprises a pre-heating zone P.H.Z. of 3.50 meters length followed by a heat treating zone at about 900° C. In the pre-heating zone, the steel tubes are progressively brought to the temperature of the hot zone.

Figure 5:
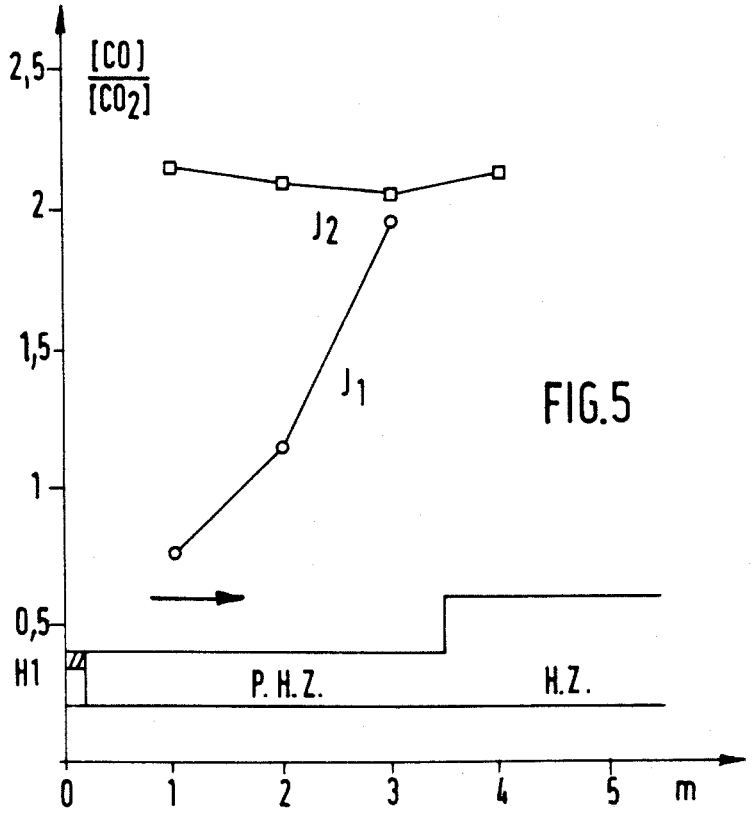
FIG. 5 is a curve showing the effect of a hood on the concentration of oxidizing species at the inlet of a continuous open furnace for annealing steel tubes.

FIG. 5 illustrates with the curves $J_2$ and $J_2$ respectively the ratio of the concentrations of carbon dioxide and carbon monoxide as a function of the distance into the furnace relative to the inlet zone. In this comparative example, a hood having a structure shown in FIGS. 3A and 3B with the dimensions given hereinafter was installed at the inlet of the furnace, the outlet of the latter communicating directly with the surrounding atmosphere. The curve $J_1$ represents the ratio of the $CO/CO_2$ concentrations in the absence of a homogeneous laminar flow of nitrogen in the hood, while the curve $J_2$ represents the same ratio of concentration with a homogeneous and laminar flow of nitrogen between the refractory screens of said hood. It is clear that the ratio of said concentrations is substantially constant throughout the length of the pre-heating zone of the furnace when a homogeneous and laminar screen of nitrogen flows between the refractory screens. This shows the use of a hood according to the invention, and there is thus found at the inlet of the furnace the reducing character of the atmosphere with respect to the treated metal.

The geometry of the hood employed was the following:

Width: 1 m
Depth: 0.15 m
Thickness of the rock wool blanket: 0.05 m
Height of the expansion chamber: 0.10 m
Diameter of the perforations: 2 mm
Centre distance of two successive perforations: 4 mm
No pre-inlet chamber
The rate of flow of nitrogen in the hood was 10 $Nm^3$ per hour.

EXAMPLE 2

This example is based on the furnace shown in FIG. 2.

This furnace is an open furnace having a conveyor belt for annealing stainless steel. The various atmospheres injected at points $GI_1$, $GI_2$, $GI_3$, $GI_4$ of the furnace are shown in the following table:

| Injection points flows in $m^3/h$ | FURNACE WITH HOODS (inlet and outlet) |
|---|---|
| $GI_1$ | O |
| $GI_2$ | $5.4(N_2) + 1.8(H_2)$ |
| $GI_3$ | $5.4(N_2)$ |
| $GI_4$ | O |
| $H_1$ (furnace inlet) | $0.5(N_2)$ |
| $H_2$ (furnace outlet) | $2.4(N_2)$ |
| Total flow | $13.7(N_2) + 1.8(H_2)$ |

Figure 6:
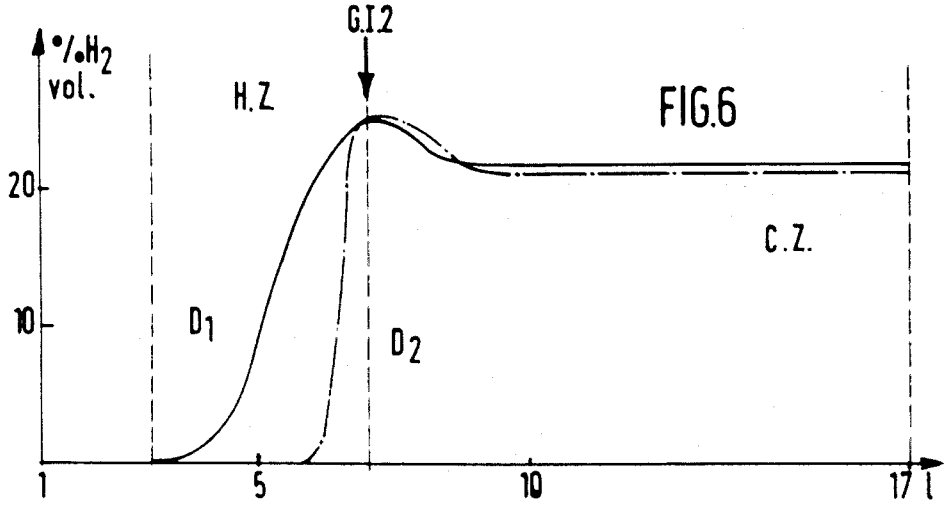
FIG. 6 is a curve showing the effect of a hood on the distribution of the gases inside a furnace.

FIG. 6 shows the concentrations of hydrogen in the furnace.

Curve $D_1$ represents the concentration of hydrogen in the furnace in the absence of a hood and curve $D_2$ represents the concentration of hydrogen in the furnace with the use of the process according to the invention summarized in the foregoing table. The injection point G.I.2 is located between the heat treating zone and the cooling zone of the furnace. According to the invention, the hydrogen is almost exclusively directed toward the cooling zone of the furnace. The parts leaving the furnace show no trace of oxidation.

The curve $D_1$ (furnace without the hood) shows that, substantially throughout the length of the hot zone HZ of the treating furnace (4 meters in this example), there is a significant concentration of hydrogen. This varies approximately from 25% at the point of injection (7 meters from the inlet zone) to about 1% at 3 meters from the inlet zone of the furnace. In the middle of this hot zone the concentration of hydrogen is about 10%.

The curve $D_2$ (furnace with hoods according to the invention) shows that the concentration of hydrogen is on the order of 1% at about 6 meters from the inlet of the furnace, ¾ of the hot zone having no hydrogen. On the other hand, the contours of the concentration of hydrogen with or without a hood in the cooling zone CZ are substantially identical.

This example shows the possibilities of achieving a precise division of heat treating furnaces into zones by means of the process according to the invention.

EXAMPLE 3

This example concerns the furnace of FIG. 1. The heat treating zone HZ was at a temperature of 800° C. with an injection of gas at the point GI between the hot zone HZ and the cooling zone CZ. In the present case, a hood was placed solely at the entrance $H_1$ of the hot zone and no hood was disposed at the outlet. The atmosphere injected was identical to that of the Example 1, which atmosphere is well-known in the art for annealing steel strips.

Figure 7A:
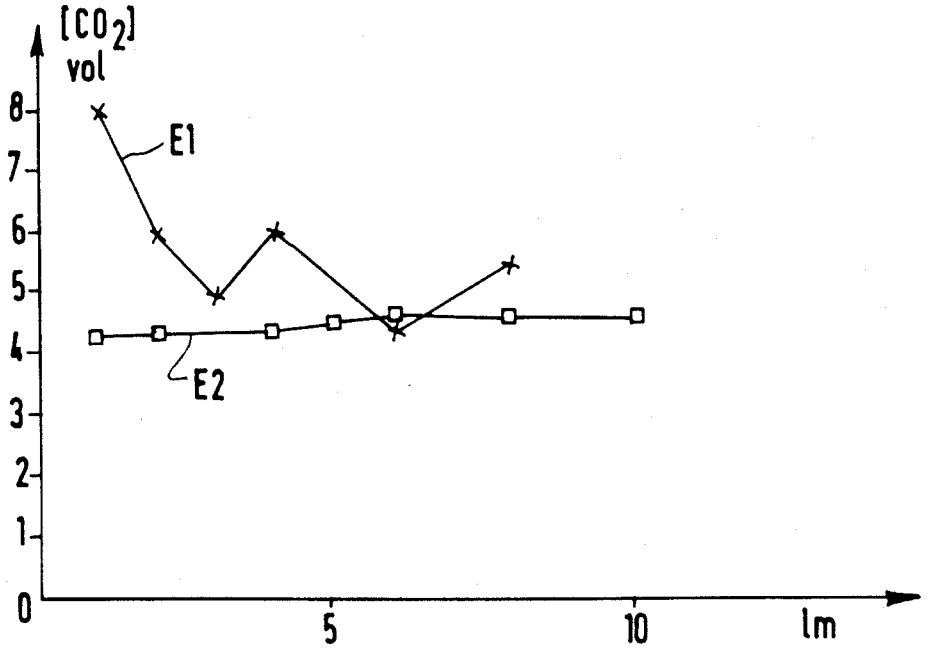
FIGS. 7A and 7B are curves showing the contours of concentration of carbon dioxide gas and water at the inlet of a continuous furnace for annealing strips.

FIG. 7A represents the concentration of carbon dioxide in the atmosphere of the furnace respectively without a hood (E1) and with a hood (E2) as a function of the abscissa of the measuring point in the furnace with respect to the inlet of the latter.

It is found that at about 6 meters from the inlet of the furnace, in respect of a heat treating zone having a total length of 20 meters, the concentration of $CO_2$ is the same in both cases, while there is a reduction of one half of the concentration of $CO_2$ at 1 meter from the inlet in the case of a furnace provided with a hood at the inlet according to the invention.

In the latter case, the concentration of $CO_2$ at the inlet of the furnace is substantially identical to that of the atmosphere injected into the furnace, which shows the absence of the entry of oxidizing species in the furnace employing the process according to the invention.

Figure 7B:
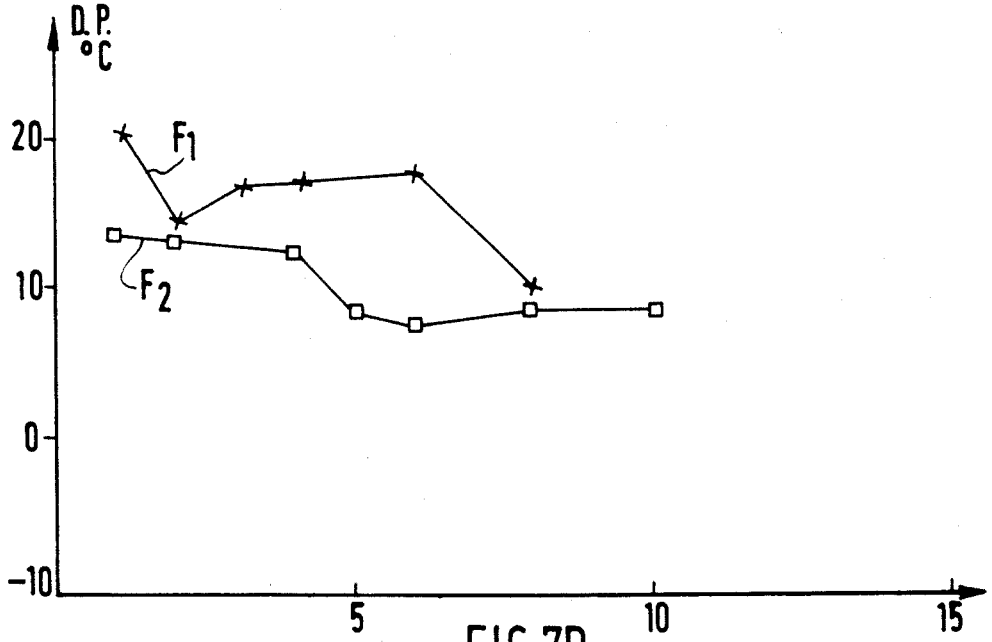

The curves $F_1$ and $F_2$ of the FIG. 7B represent the variations of the dew point in °C. in a furnace without a hood and with a hood respectively relative to the abscissa of the measuring point of the furnace with respect to the inlet. The dew point is distinctly lower with a hood (curve $F_2$), this dew point being substantially identical in both cases at 8 meters from the inlet of the furnace. Consequently, the concentration of $H_2O$, oxidizing species, in the furnace employing the process according to the invention is also maintained constant up to the inlet of the furnace.

In these two examples, the flow of neutral gas in the hoods, i.e. nitrogen in the present case, was 2.5 $m^3$/hour.

Figure 8:
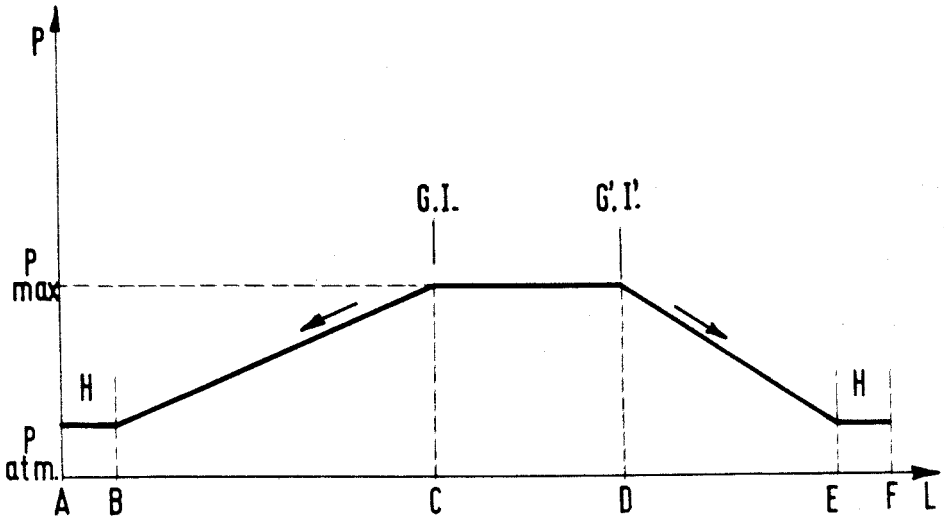
FIG. 8 illustrates an embodiment of the process according to the invention with the furnace divided into zones.

FIG. 8 illustrates a preferred example of the process according to the invention, requiring at least two points of injection of gas in the treating furnace. This variant is characterized by the equal pressures at the injection points GI and G'I' of the furnace. This permits the obtainment of a zone CD in the furnace in which the gas pressure is substantially constant. Consequently, there is achieved an excellent division of the furnace into zones, since the gas issuing from the point GI will travel almost exclusively toward the outlet AB of the furnace, while the gas issuing from the injection point G'I' will travel almost exclusively toward the outlet EF of the furnace. The only diffusion of the gases occurs in the zone CD, which diffusion occurs at a very low velocity. If this variant of the invention is applied to the furnace of FIG. 2, in choosing an injection of gas only at $GI_2$ and $GI_3$, i.e. at the entrance and exit of the hot zone HZ, the latter will have the characteristics of the zone CD described hereinbefore. In particular, the following relations concerning the pressures will be noted:

$$Pt_{max}=Pf_{max}>Ph_{max}>Pa$$

It will be understood that it is possible to retain for the zone CD its properties while effecting other injections of gas into the furnace in the zones BC and DE of the latter at a pressure lower than $Pt_{max}$ and $Pf_{max}$.

Figure 9A:
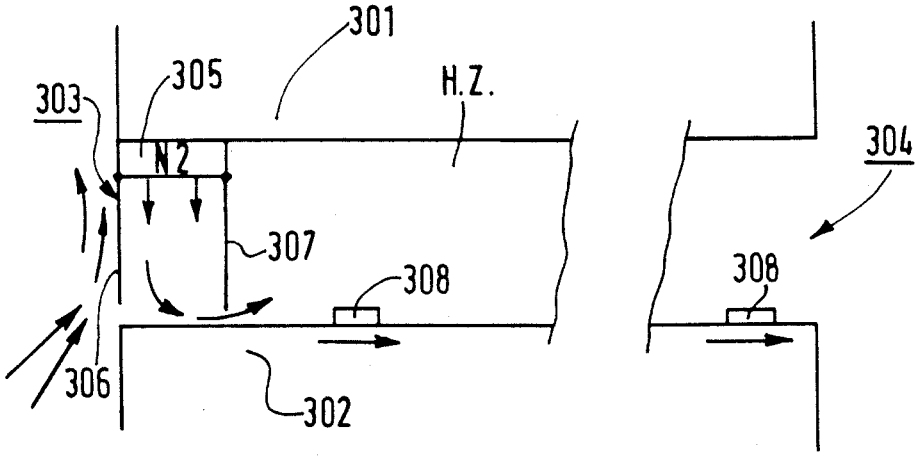
FIGS. 9A and 9B show a preferred embodiment of the furnace according to the invention.
Figure 9B:
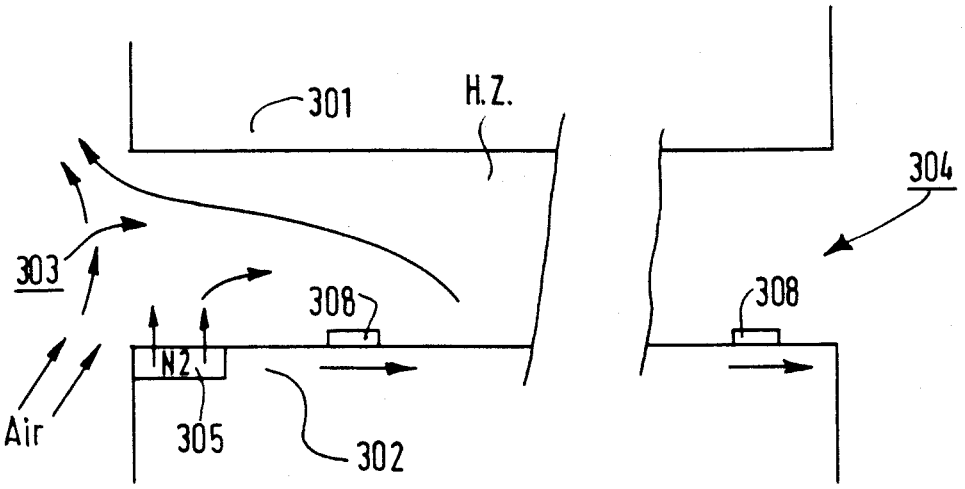

FIGS. 9A and 9B show a preferred embodiment of the invention in which a screen of inert or inactive gas ($N_2$ in the figure) is used solely at the inlet of the furnace.

In FIG. 9A the furnace has been diagrammatically represented in section solely in the region of its inlet 303 and its outlet 304. Placed at the inlet 303 of the furnace is a hood 305 provided with refractory screens 306 and 307 such as those illustrated in FIGS. 3 and 4, this hood being connected to the upper part 301 of the furnace. The refractory screens have their lower ends located close to the lower part 302 of the furnace which is usually provided with a conveyor belt for feeding the objects to be treated, such as 308. A distance on the order of a few centimeters between the lower end of the screens 306 and 307 and the lower part 302 of the furnace is quite suitable in practice. No particular device is placed at the outlet 304 of the furnace. In order to determine the rate of flow of inert or inactive gas (usually nitrogen) which must be injected into the hood 305 in the manner described hereinbefore, there is first of all measured in the region of the screens 306 and 307, in the absence of injection of nitrogen, the flow of air which enters the furnace owing to the natural convection phenomena. This measurement is carried out by means of a hot wire in the known manner.

The same flow of nitrogen is then injected into the hood. It is found, as diagrammatically represented by the arrows in the Figure, that the nitrogen flows between the screens and then enters the furnace instead of the air. The latter, although it is drawn toward the inlet, flows along the screen 306 without passing therethrough. The large reduction in the content of oxygen in the furnace is easily ascertained by measuring the concentration of the oxygen by means of a probe placed in the furnace beyond the screen 307.

In FIG. 9B, the same elements as those shown in FIG. 9A carry the same reference characters. The hood 305 is placed in this embodiment in the lower part of the furnace without refractory screens. The flow of nitrogen is regulated in the manner indicated hereinbefore. It is found, as before, that the air arriving in the vicinity of the inlet of the furnace does not enter the latter but is drawn upwardly by the current of the atmosphere issuing from the upper part of the inlet of the furnace.

The use of the process illustrated in FIGS. 9A and 9B enables the flows of atmosphere used in heat treating furnaces to be reduced irrespective of the number and nature of the points of injection of gas into the latter, for its given oxygen content in the hot zone of the furnace. As an example, a continuous furnace having an inlet zone 2 meters long, a hot zone at 800° C. 5 meters long, a water-cooled zone 10 meters long and an inlet section of about 0.2 $m^2$, consumed when its two ends were open, 100 $Nm^3/h$ of nitrogen for producing a protecting atmosphere adapted for the annealing of copper parts. After having placed two refractory screens (the lower ends of which are each at less than 5 cm from the lower part of the furnace) and a suitable hood at the inlet of the inlet zone) the velocity of the air at the inlet of the furnace is measured in the absence of nitrogen in the hood. This velocity is 37 cm/s. Nitrogen is then injected at 37 cm/s in said hood, which corresponds to a rate of flow of nitrogen of 30 $Nm^3/h$. The rate of flow of nitrogen in the furnace may then be brought to 20 $Nm^3/h$ for an identical quantity of products at the outlet of the furnace. There is therefore found an overall reduction of 50% of the nitrogen flows in this furnace.

I claim:

1. A process for heat treating parts in a continuous furnace which furnace comprises an inlet zone, an outlet zone, at least one heat treating zone and means for producing an atmosphere of non-reactive gas under the heat treating conditions in said inlet zone so as to substantially avoid entry of air into the furnace, said process comprising the steps of:

(a) feeding the parts to be treated in succession into the furnace in a given direction;

(b) injecting an atmosphere of a given composition into said heat treating zone; and (c) preventing entry of air into the furnace by:

(i) creating a substantially homogeneous screen of said atmosphere of non-reactive gas by injecting in said inlet zone the non-reactive gas in a plane through which extends said direction of feed of the parts to be treated, said injection being made under such conditions that a substantially laminar flow condition is maintained substantially throughout the height of said screen of non-reactive gas; and (ii) controlling the rate of flow of non-reactive gas injected in said inlet zone by injecting said non-reactive gas with a flow rate equal to the flow rate of air which enters the furnace owing to natural convection phenomena in the absence of said injection of non-reactive gas, so that the injected, non-reactive gas is substituted for air which, in the absence of the homogeneous, laminar screen, would be sucked into the furnace due to natural convection phenomena.

2. A process according to claim 1, wherein the means for producing an atmosphere of non-reactive gas comprise two screens of refractory material extending substantially to the movable support between which the screen of non-reactive gas is injected in the upward direction.

3. A process according to claim 1, comprising creating the substantially homogeneous gas screen by an upward injection of non-reactive gas.

4. a process according to claim 1, comprising injecting the non-reactive gas in a substantially vertical plane.

5. A process according to claim 1, wherein the heat treating furnace comprises two points of injection of non-ractive gas, said process comprising injecting non-reactive gas at equal pressures at said two points so as to maintain a zone of equal pressure therebetween, the injected gases flowing on each side of said zone.

6. A process according to claim 1, wherein the gas pressures in the furnace are related by a selected one of the following relations:

$$Pa < Ph_{max} < Pt_{max} \geqq Pf_{max} > Pa$$

and $$Pa < Ph_{max} < Pf_{max} \geqq Pf_{max} \geqq$$

wherein:

Pa is the atmospheric pressure;

$Ph_{max}$ is the maximum pressure of the injected non-reactive gas;

$Pt_{max}$ is the maximum pressure in the heat treating zone;

$Pf_{max}$ is the maximum pressure in the cooling zone of the furnace.

* * * * *